US005634784A

United States Patent [19]

Pfefferle et al.

[11] Patent Number: 5,634,784

[45] Date of Patent: Jun. 3, 1997

[54] CATALYTIC METHOD

[75] Inventors: William C. Pfefferle, Middletown, N.J.; E. Jack Sweet, Trumbull, Conn.

[73] Assignee: Precision Combustion, Inc., New Haven, Conn.

[21] Appl. No.: 227,599

[22] Filed: Apr. 14, 1994

Related U.S. Application Data

[63] Continuation-in-part of Ser. No. 835,556, Feb. 14, 1992, Pat. No. 5,453,003, which is a continuation-in-part of Ser. No. 639,012, Jan. 9, 1991.

[51] Int. Cl.[6] ..... F02M 27/02

[52] U.S. Cl. ..... 431/7; 431/170; 431/326; 431/353; 431/116; 60/723

[58] Field of Search ..... 431/7, 8, 9, 116, 431/170, 181, 183, 187, 353; 60/723

[56] References Cited

U.S. PATENT DOCUMENTS

| | | | |
|---|---|---|---|
| 4,930,454 | 6/1990 | Latty et al. | 431/7 |
| 5,250,489 | 10/1993 | Dalla Betta et al. | 431/7 |
| 5,340,020 | 8/1994 | Maus et al. | 431/7 |
| 5,453,003 | 9/1995 | Pfefferle | 431/170 |

*Primary Examiner*—Carl D. Price
*Attorney, Agent, or Firm*—Kane, Dalsimer, Sullivan, Kurucz, Levy, Eisele and Richard

[57] ABSTRACT

Gas phase combustion producing lower emissions in gas turbines is stabilized in a lean pre-mixed combustor, by flow of the fuel/air mixture through a catalyst which is heated by contact with recirculated, partially reacted combustion gases.

10 Claims, 2 Drawing Sheets

CATALYTIC METHOD

CROSS-REFERENCE TO RELATED APPLICATION

This invention is a continuation-in-part of the U.S. patent application Ser. No. 07/835,556 filed Feb. 14, 1992, now U.S. Pat. No. 5,453,003, which is a continuation-in-part of U.S. patent application Ser. No. 07/639,012 filed on Jan. 9. 1991.

FIELD OF THE INVENTION

This invention relates to improved systems for low $NO_x$ combustion of fuels and to methods for catalytic extension of lean limits. In one specific aspect, this invention relates to catalytic stabilization of dry low $NO_x$ combustors.

BRIEF DESCRIPTION OF THE PRIOR ART

Although it has been established that premixed aerodynamically stabilized dry low $NO_x$ combustion systems for gas turbines can achieve $NO_x$ levels below 10 ppm, the operability of such combustors is poor because of the need to operate well above the lean limit which is typically at a flame temperature greater than about 1750° Kelvin. To achieve operation over the range of power levels required for a gas turbine, multiple staging of combustion is typically employed resulting in the need for multiple fuel controls. The result is a danger of flame-out in transient operation and typically an inability to achieve low emissions over the full operating range.

Catalytic combustors of U.S. Pat. No. 3,928,961 can achieve $NO_x$ levels even lower than such dry low $NO_x$ combustors. However, the current maximum operating temperature of such combustors is limited to no more than about 1600° Kelvin by the lack of durable catalysts suitable for operation at temperatures higher then 1600° Kelvin. Moreover, for natural gas combustion present catalysts typically require combustor inlet temperatures higher than available with typical multi-spool engines at low power levels.

The present invention overcomes the limitations of these prior art systems and meets the need for reduced emissions from gas turbines and other combustion devices.

SUMMARY OF THE INVENTION

Definition of Terms

The terms "fuel" and "hydrocarbon" as used in the present invention not only refer to organic compounds, including conventional liquid and gaseous fuels, but also to gas streams containing fuel values in the form of compounds such as carbon monoxide, organic compounds or partial oxidation products of carbon containing compounds.

The Invention

In the present invention gas phase combustion is stabilized in a lean premixed combustor by reaction of a gaseous mixture of fuel and air passing in radial flow through a catalyst which is heated in operation by contact with recirculating partially reacted combustion gases.

As noted in co-pending application Ser. No. 835,556, incorporated by reference it has been found that a catalyst can stabilize gas phase combustion of very lean fuel-air mixtures at flame temperatures as low as 1000° or even below 900° Kelvin, far below not only the minimum flame temperatures of conventional combustion systems but even below the minimum combustion temperatures required for the catalytic combustion method of the earlier system described in U.S. Pat. No. 3,928,961. In addition, with use of mesolith catalysts the upper operating temperature is not materials limited since the catalyst can be designed to operate at a safe temperature well below the combustor adiabatic flame temperature.

The catalyst is an oxidation catalyst, preferably a metal from the group VIII of the periodic system of elements.

In the present invention it is taught that a radial flow catalyst element can be integrated into an aerodynamically stabilized burner to provide a catalytically reacted fuel-air mixture for enhanced flame stabilization with catalyst temperature maintained by recirculation of hot combustion gases at a temperature high enough even for combustion of methane at ambient combustor inlet air temperatures yet at a temperature well below the adiabatic combustion temperature thus allowing burner outlet temperatures high enough for modern gas turbines. An aerodynamically stabilized combustor or burner is one wherein gas phase combustion is stabilized by aerodynamic recirculation of hot combustion products such as induced by a swirler; a bluff body; opposed flow jets; or a flow dump. These devices are well known in the art. Preferred are swirlers. In operation of a burner of the present invention, a fuel-air mixture is passed into contact with a catalytic element for reaction thereon. The resulting reacted admixture is then admixed with the fresh fuel and air passing into the combustor thus enhancing reactivity and enabling stable combustion even with very lean fuel-air admixtures of 0.2 or even 0.1 equivalence ratio. Light-off of burners of the present invention may be achieved using any conventional ignition means such as spark plugs, glow plugs, laser beams, or microwave energy. Advantageously, for ignition the catalytic element is heated electrically to a temperature high enough for fuel ignition followed by introduction of fuel and air. This not only achieves ignition but assures that the catalyst is at an effective temperature to stabilize lean combustion in the burner from the start of combustion.

Thus, the present invention makes possible practical ultra-low emission combustors using available catalysts and catalyst support materials, combustors which are capable of operating not only at the low combustion temperatures of conventional catalytic but also of operating at the high combustor outlet temperatures required for full power operation of modern gas turbines. Such a wide operating temperature range represents a high turndown ratio and makes possible catalytically stabilized combustors with a high enough turndown ratio to significantly reduce the need for staging as compared to conventional dry low $NO_x$ systems or for the need for variable geometry.

In one advantageous embodiment of the present invention, a fuel-air mixture is contacted with a combustion catalyst to produce heat and reactive intermediates for admixture with fuel and air entering coaxially through a swirler thus providing continuous enhancement of stability in the resulting swirl stabilized combustion. Stable high combustion is possible at temperatures not only well below a temperature resulting in significant formation of nitrogen oxides from molecular nitrogen and oxygen but often even below the minimum temperatures of prior art catalytic combustors. Combustion of lean fuel-air mixtures have been stabilized at bulk equivalence ratios as low as 0.2 with methane, well below the level for a conventional catalytic combustor. The generation of heat and radicals by the catalyst is believed to counter the quenching of free radicals which otherwise quench combustion at temperatures which are low enough to minimize formation of thermal $NO_x$. The catalyst is preferably in the form of a short channel length radial flow mesolith.

Use of electrically heatable catalysts provides both ease of light-off and ready relight in case of a flameout such as may result from an interruption in fuel flow. With spark ignition, the spark plug is advantageously positioned on the burner centerline within the catalytic element. Extra fuel may be introduced in the vicinity of the spark plug to assure a sufficiently flammable mixture for flame propagation in an otherwise overall lean fuel-air mixture. After lightoff, the catalyst is maintained at an effective temperature by catalytic reaction and by heat from the reverse flow hot combustion gases.

For stationary gas turbines, the capability to burn natural gas is most important as are ultra-low $NO_x$ levels, i.e.; below 10 ppm and preferably below about one ppm. Thus, the capability of burners of the present invention to burn methane, the primary constituent of natural gas, makes possible not only low emissions of $NO_x$ but economic production of electrical power. A further advantage of combustors of the present invention is their suitability for use as low $NO_x$ pilot burners to stabilize leaner combustion in conventional dry low $NO_x$ designs thus even allowing retrofitting of existing combustors.

DETAILED DESCRIPTION OF THE PREFERRED EMBODIMENTS OF THE INVENTION

Figure 1:
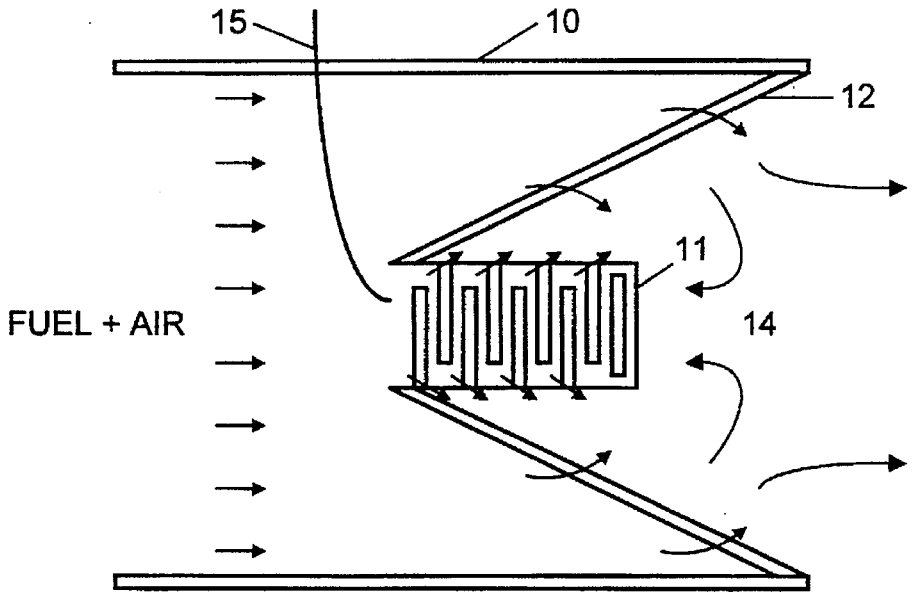
FIG. 1 shows a schematic of a high turn down ratio catalytically enhanced swirl stabilized burner.

In FIG. 1, fuel and air are passed into contact with a radial flow mesolith catalyst 11 mounted within swirler 12 such that reacted gases from catalyst 11 are directed into admixture with the fuel and air passing through swirler 12 whereby the combustion effluent from catalyst 11 enhances efficient gas phase combustion of very lean fuel-air mixtures in reaction zone 14. Electrical leads 15 provide power for heating catalyst 11 to an effective temperature for reaction of the fuel-air mixture for light-off. Recirculating combustion gases (shown by the arrows) maintains an effective catalyst temperature at low combustor inlet temperatures. Thus efficient combustion of lean premixed fuel-air mixtures is stabilized at flame temperatures below a temperature which would result in any substantial formation of oxides of nitrogen. This temperature is dependent in part upon the fuel utilized.

Figure 2:
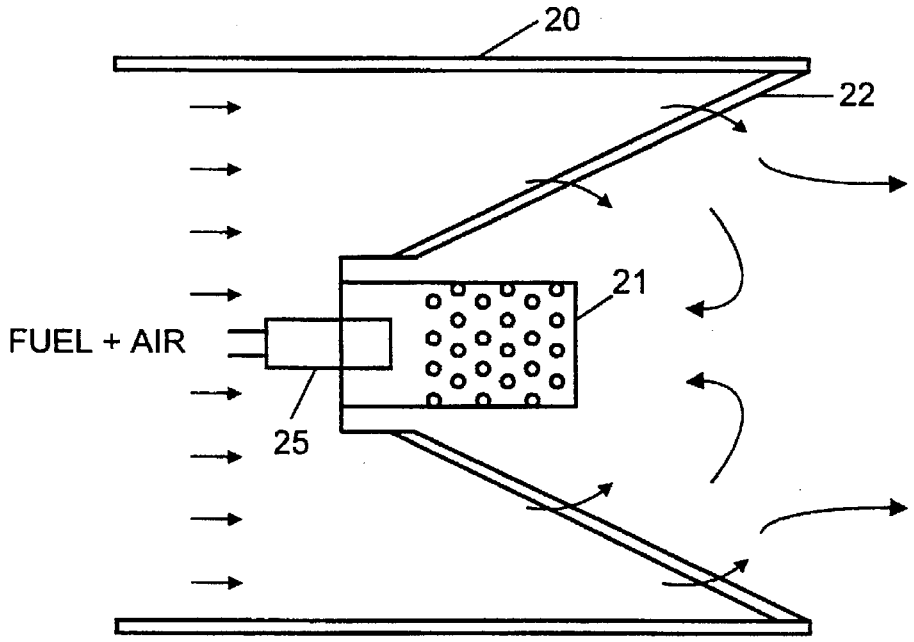
FIG. 2 shows a burner with an integral spark plug.

FIG. 2 shows burner 20 in which a spark plug 25 is mounted within the interior of catalyst 21 in swirler 22 to provide integral means for ignition of burner 20. Recirculating partially reacted combustion gases (flow path shown by arrows) react on contact with catalyst 21. Burner 20 may be used as a continuously operating pilot burner in a dry low $NO_x$ combustor in place of a conventional diffusion flame pilot as may the burner of FIG. 1.

Figure 3:
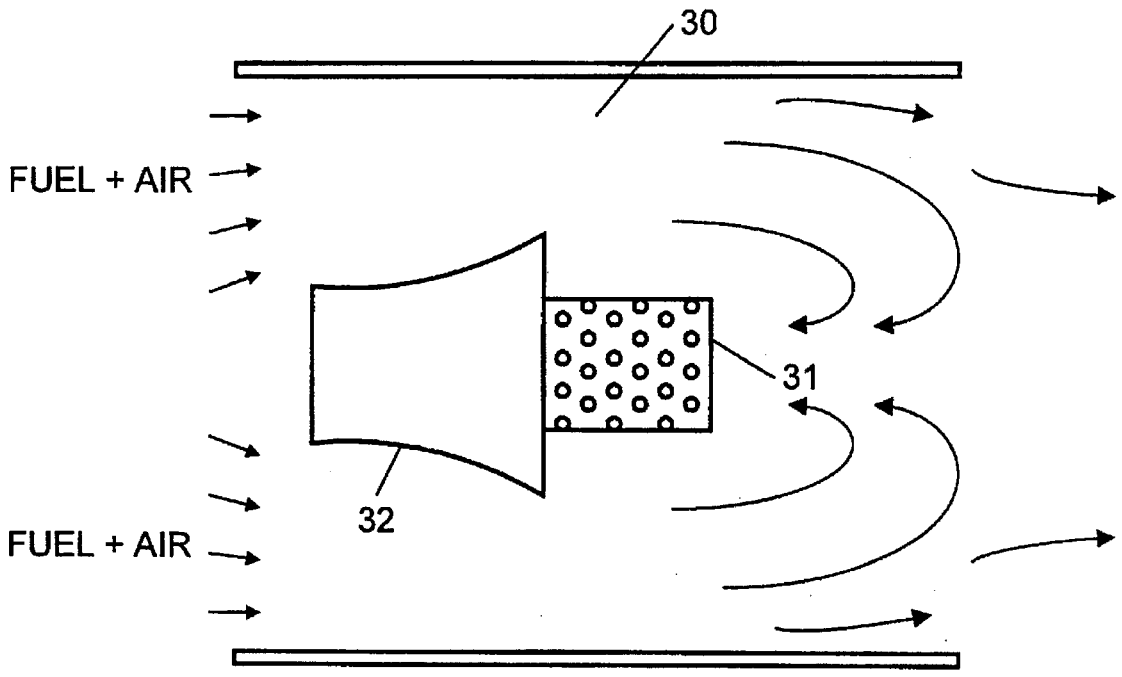
FIG. 3 shows dump combustor having radial flow catalyst.

FIG. 3 shows a dump combustor 30 in which recirculating combustion gases flow over body 32 and through catalyst 31 as shown by the arrows, thereby stabilizing lean combustion.

The following Example shows the manner and method of carrying out the invention and sets forth the best mode contemplated by the inventors, but is not to be construed as limiting the invention.

EXAMPLE 1

Lean gas phase combustion of methane is stabilized by spraying the fuel into flowing ambient temperature air and passing the resulting fuel-air mixture through a heated platinum activated catalyst mounted within a swirler such that fuel reacted on the catalyst is mixed with fuel and air passing through the swirler resulting in stable combustion with release of heat, producing less than ten ppm $NO_x$, and less than 5 ppm of CO and unburned hydrocarbons. Additional premixed fuel and air may be added downstream of the catalytic burner to produce a high throughput low pressure drop low $NO_x$ combustor of greater turndown than is possible even with catalytic stabilization. For ignition using a spark plug, the fuel air ratio must be suitably rich for initial flame propagation prior to transitioning to lean operation.

What is claimed is:

1. A method for efficient combustion of fuel-air admixtures having an adiabatic flame temperature below 2000° Kelvin which comprises:

a. reacting fuel with air in the presence of an oxidation catalyst disposed within a fuel burner, b. passing additional fuel and air into said burner, c. mixing said reacted fuel and air with said additional fuel and air, d. aerodynamically stabilizing combustion of the mixture of reacted fuel and air with the additional fuel and air;

e. recirculating hot combustion products into contact with said catalyst to maintain said catalyst at a temperature effective for reaction of the fuel and air.

2. The method of claim 1 wherein passing the additional fuel and air is through vanes of a flow swirler.

3. The method of claim 1 wherein said catalyst comprises a metal of group VIII of the periodic table of elements.

4. The method of claim 1 wherein said aerodynamic stabilization is achieved using swirlers.

5. The method of claim 1 wherein said aerodynamic stabilization is achieved with a flow dump.

6. The method of claim 1 wherein said reacted fuel is a hydrocarbon.

7. A burner for clean combustion of fuels comprising:

a. a tubular housing defining a tube lumen having an open first end and an open second end;

b. aerodynamic combustion stabilization means mounted in the tube lumen between the first and the second end, said means having flow passages for passage of fuel and air in admixture;

c. an oxidation catalyst within a passage of said aerodynamic means for combustion of fuel and air mixtures so as to provide reaction gases for admixture with additional fuel and additional air;

d. means to provide a fuel-air mixture to said catalyst for combustion;

e. a zone between the catalyst and the second open end of the lumen, for mixing the reaction gases and the additional fuel and the additional air and for recirculating the reaction gases mixed with additional fuel and additional air to the oxidation catalyst for further combustion; and f. means of delivering the additional fuel and the additional air to said zone.

8. The burner of claim 7 further comprising means to electrically heat said catalyst.

9. The burner of claim 7 wherein said aerodynamic stabilization means is a dump combustor.

10. The burner of claim 9 wherein said aerodynamic means comprises a swirler having vanes and flow passages formed by the swirler vanes.

* * * * *